US007947913B1

(12) United States Patent
Moore

(10) Patent No.: US 7,947,913 B1
(45) Date of Patent: May 24, 2011

(54) SLIDE BAR INTERLOCKING DEVICE

(75) Inventor: Marshall R. Moore, Tampa, FL (US)

(73) Assignee: Tampa Armature Works, Inc., Riverview, FL (US)

( * ) Notice: Subject to any disclaimer, the term of this patent is extended or adjusted under 35 U.S.C. 154(b) by 115 days.

(21) Appl. No.: 12/570,797

(22) Filed: Sep. 30, 2009

(51) Int. Cl.
*H01H 9/26* (2006.01)

(52) U.S. Cl. ..... 200/50.32

(58) Field of Classification Search ..... 200/50.33, 200/50.32, 50.35, 50.36, 43.16, 43.18, 43.19, 200/5 B, 5 E, 5 EA, 5 EB
See application file for complete search history.

(56) References Cited

U.S. PATENT DOCUMENTS

| | | | | |
|---|---|---|---|---|
| 4,286,242 | A | 8/1981 | Mrenna et al. | |
| 4,924,041 | A | 5/1990 | Yee | |
| 5,357,070 | A | 10/1994 | Parsons, Jr. | |
| 5,558,209 | A | 9/1996 | Mohsen | |
| 5,726,401 | A | 3/1998 | Green et al. | |
| 5,874,698 | A | 2/1999 | Collis | |
| 5,902,974 | A | 5/1999 | Fogle et al. | |
| 6,096,986 | A | 8/2000 | Flegel | |
| 6,184,482 | B1 | 2/2001 | Priem | |
| 6,320,143 | B1 * | 11/2001 | Greer | 200/50.33 |
| 6,396,008 | B1 | 5/2002 | Maloney et al. | |
| 6,563,063 | B1 | 5/2003 | Moore | |
| 6,815,623 | B1 * | 11/2004 | Holland | 200/50.32 |
| 6,872,900 | B1 * | 3/2005 | Lament et al. | 200/50.32 |
| 7,176,395 | B2 * | 2/2007 | Holland | 200/50.32 |

* cited by examiner

*Primary Examiner* — Edwin A. Leon
(74) *Attorney, Agent, or Firm* — Ronald E. Smith; Smith & Hopen, P.A.

(57) ABSTRACT

A slide bar interlocking device includes a first group of constrained switch actuators and a second group of unconstrained switch actuators. Only one unconstrained actuator in the first group may be thrown in combination with any switch actuator in the second group and any combination of switch actuators in the second group. A base plate has a fixed position and a movable plate is slideably mounted to the base plate. A plurality of elongate slots is formed in the movable plate and at least one truncate slot is formed in each of the elongate slots. The movable plate has first, second, third, and fourth positions where a switch actuator in the first group is in alignment with a truncate slot so that the aligned switch actuator can be thrown and where all other switch actuators in the first group cannot be thrown.

9 Claims, 6 Drawing Sheets

FIG. 3
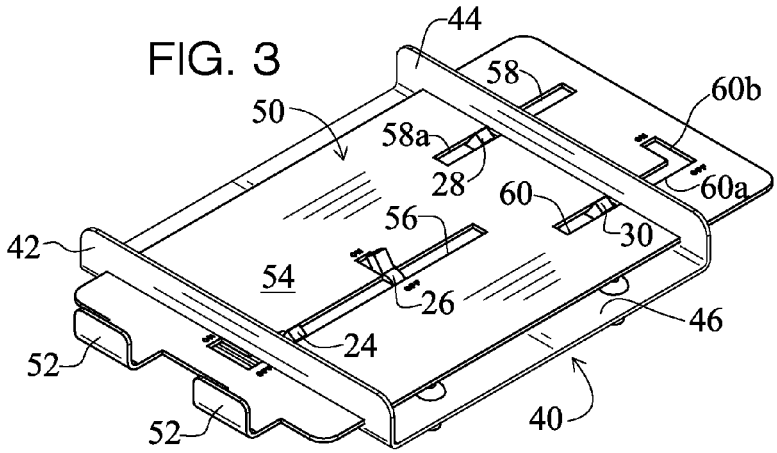
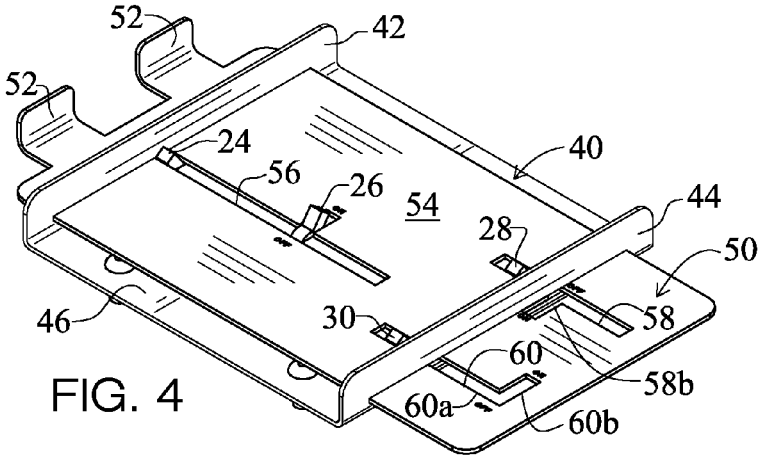
FIG. 4
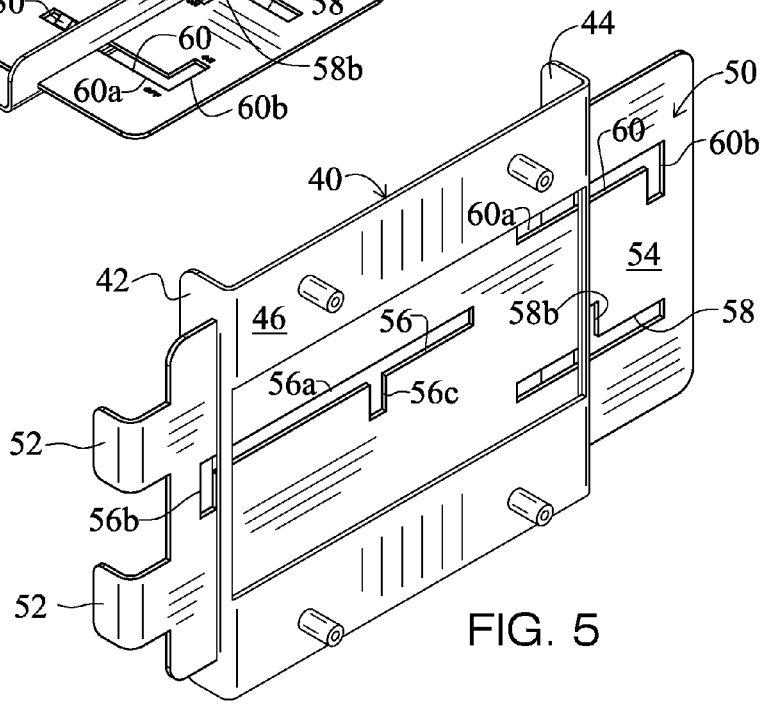
FIG. 5

FIG. 6
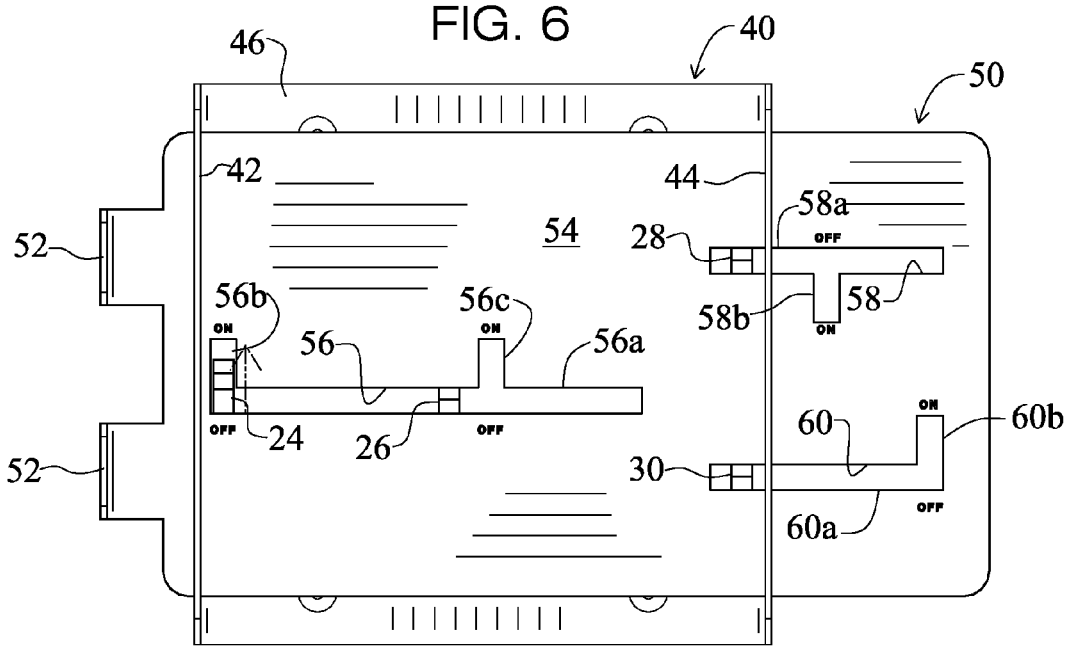
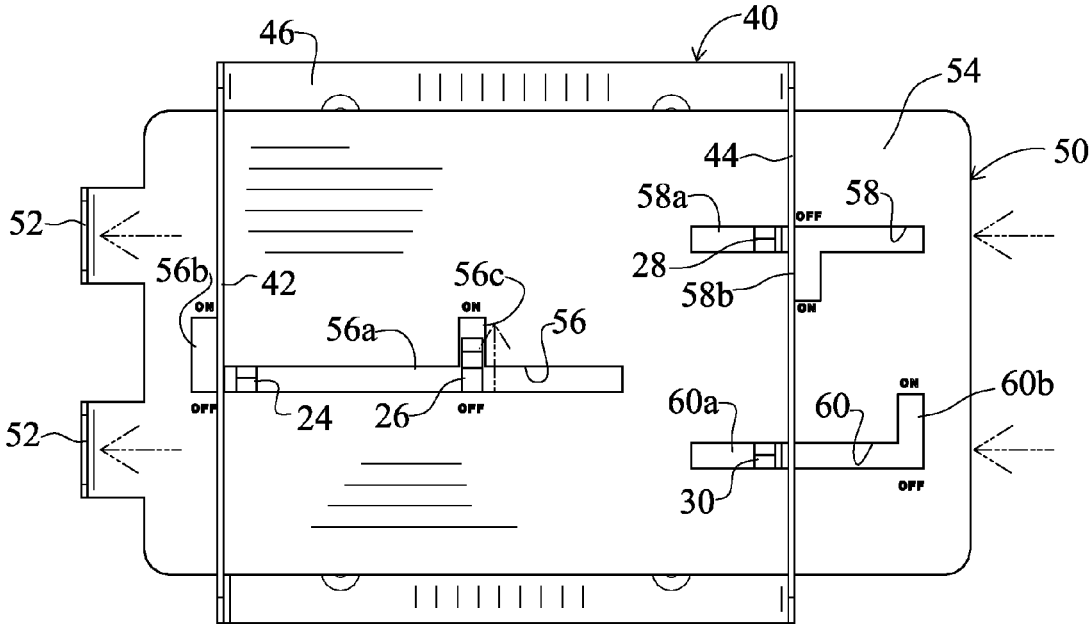
FIG. 7

FIG. 8
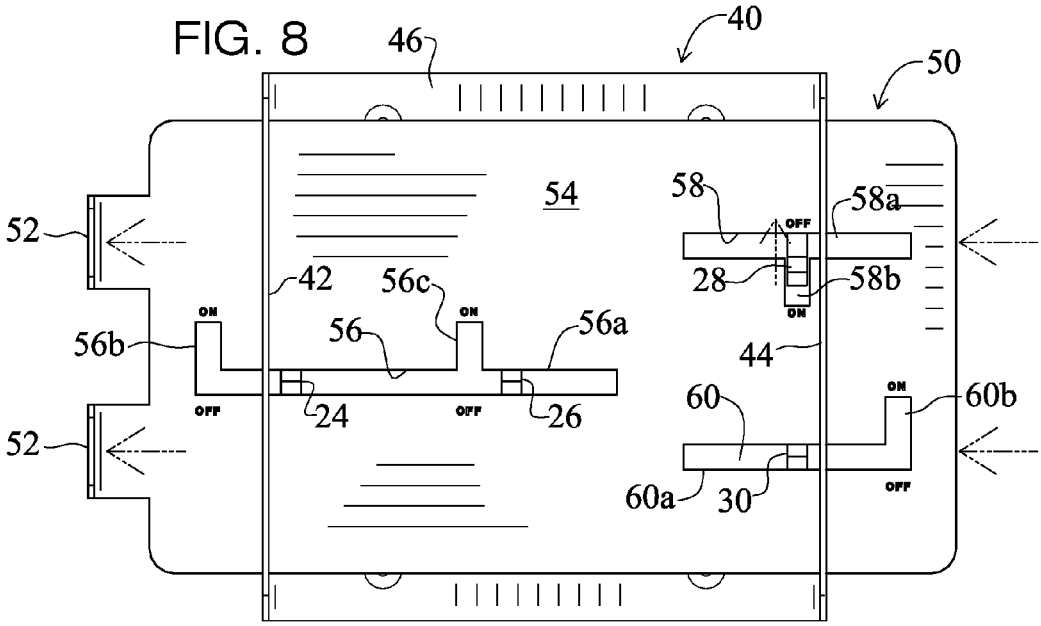
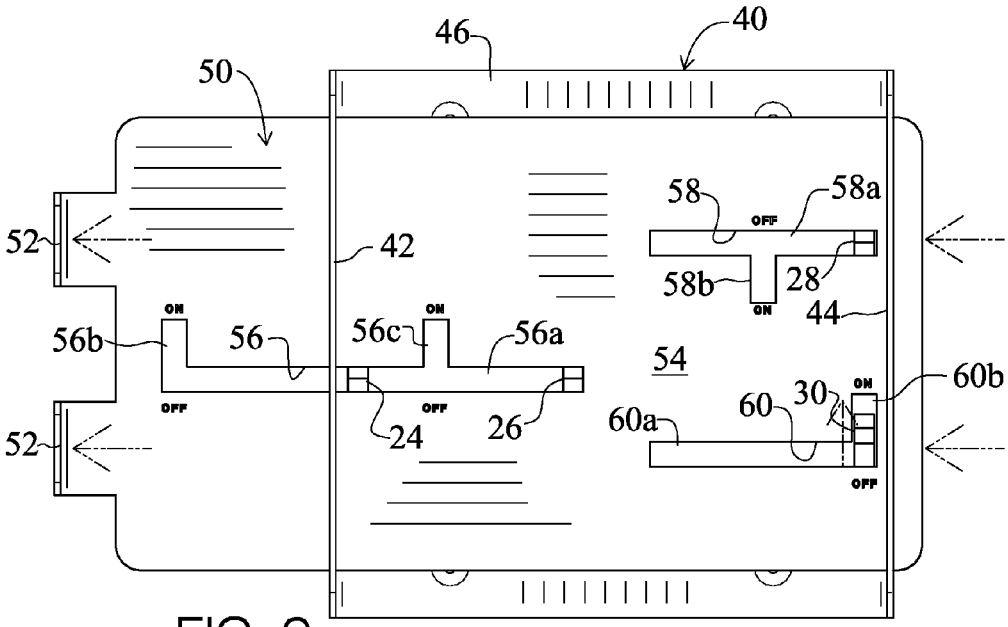
FIG. 9

SLIDE BAR INTERLOCKING DEVICE

FIELD OF THE INVENTION

This invention relates, generally, to interlocking devices. More particularly, it relates to an interlocking means for preventing the throwing of more than one switch actuator in a first group of actuators when any actuator in a second group of actuators is thrown.

DESCRIPTION OF THE PRIOR ART

Power distribution centers require cooperation between plural switch actuators. Typically, the actuators toggle power between alternate sources and are positioned adjacent one another for convenience. When one switch is thrown to an "on" position, a complementary switch should be in an "off" position and vice versa. However, the convenience of having switches in close proximity to one another leads to the possibility that contiguous switches might be thrown simultaneously. A variety of interlocking devices have therefore been developed to prevent the simultaneous throwing of contiguous switches.

U.S. Pat. No. 6,563,063 to the present inventor represents the closest prior art to the present invention. It discloses a locking bar that prevents simultaneous throwing of two (2) contiguous switch actuators.

U.S. Pat. No. 5,902,974 to Fogle et al. discloses a slide bar interlock specifically for use with contiguous circuit breakers having dissimilar actuating means. Similarly, U.S. Pat. No. 4,286,242 to Mrenna et al. discloses plungers that engage the internal operating mechanisms of circuit breakers.

Earlier interlocks also are limited to interlocking two (2) contiguous switches. Such interlocks lack utility in applications where there is a greater plurality of actuators in close proximity to one another. For example, some installations include two (2) groups of switch actuators. All, one, or any combination of the switch actuators in the second group may be actuated together, but only one of the switch actuators in the first group should be actuated when any of the second group actuators are actuated.

Thus there is a need for a switch actuator interlock that is durable, reliable, easy to operate.

More particularly, there is a need for an interlock device that constrains all but one (1) actuator in a first group of actuators when any actuator in a second group of actuators is actuated.

However, in view of the prior art taken as a whole at the time the present invention was made, it was not obvious to those of ordinary skill how the identified needs could be fulfilled.

SUMMARY OF THE INVENTION

The long-standing but heretofore unfulfilled need for an interlocking device for adjacent circuit breakers that is easy to operate, relatively failsafe, and that prevents simultaneous throwing of plural switch actuators grouped into two separate groupings is now provided in the form of a new, useful and non-obvious device.

The novel interlocking device includes eight (8) switch actuators mounted on a support surface. Each switch actuator has an "on" position and an "off" position.

More particularly, the novel slide bar interlocking device includes a first group of switch actuators and a second group of switch actuators. Each switch actuator in said second group is unconstrained so that any switch actuator in said second group and any combination of switch actuators in said second group can be thrown at any time. Each switch actuator in the first group of switch actuators is constrained when any preselected switch actuator in the first group is unconstrained so that only one unconstrained actuator in the first group may be thrown in combination with any switch actuator in the second group and any combination of switch actuators in the second group.

The novel structure further includes a base plate having a fixed position and a movable plate that is slideably mounted to the base plate. A plurality of elongate slots is formed in the movable plate and at least one truncate slot is formed in each of the elongate slots in open communication therewith and in normal relation thereto.

The movable plate has a first position where a first switch actuator in the first group of switch actuators is in alignment with a first truncate slot so that the first switch actuator can be thrown and where all other switch actuators in the first group of switch actuators are not in alignment with a truncate slot so that none of said all other switch actuators can be thrown.

The movable plate has a second position where a second switch actuator in the first group of switch actuators is in alignment with a second truncate slot so that the second switch actuator can be thrown and where all other switch actuators in the first group of switch actuators are not in alignment with a truncate slot so that none of said all other switch actuators can be thrown.

The movable plate has a third position where a third switch actuator in the first group of switch actuators is in alignment with a third truncate slot so that the third switch actuator can be thrown and where all other switch actuators in the first group of switch actuators are not in alignment with a truncate slot so that none of said all other switch actuators can be thrown.

The movable plate has a fourth position where a fourth switch actuator in the first group of switch actuators is in alignment with a fourth truncate slot so that the fourth switch actuator can be thrown and where all other switch actuators in the first group of switch actuators are not in alignment with a truncate slot so that none of said all other switch actuators can be thrown.

The plurality of elongate slots includes a first elongate slot, a first truncate slot, and a second truncate slot. The first and second truncate slots are spaced apart from one another and the first and second truncate slots are formed in open communication with the first elongate slot and the first and second truncate slots are disposed normal to the first elongate slot. The first truncate slot is positioned at a leading end of the first elongate slot and the second truncate slot is positioned about two-thirds of the length of the first elongate slot, measured from the leading end.

The plurality of elongate slots includes a second elongate slot and a first truncate slot. The first truncate slot is formed in open communication with the second elongate slot and the first truncate slot is disposed normal to the second elongate slot. The first truncate slot is formed in the second elongate slot about mid-length thereof.

The plurality of elongate slots further includes a third elongate slot and a first truncate slot. The first truncate slot is formed in open communication with the third elongate slot and the first truncate slot is disposed normal to the third elongate slot. The first truncate slot is formed in the third elongate slot at a trailing end thereof.

An important object is to provide an improved interlocking device for use with circuit breakers and the like that prevents the simultaneous throwing of at least two groups of four switch actuators per group that are positioned in close proximity to one another.

Another object is to provide an interlocking device that can be operated easily.

Still another object is to provide a relatively failsafe device that protects associated equipment and operators from harm.

Yet another object is to provide a locking device suitable for use with different equipment without modification.

Further objects include the provision of interlocking devices that are durable and not susceptible to breakage.

These and other important objects, advantages, and features of the invention will become clear as this disclosure proceeds.

The foregoing summary and the following detailed description are explanatory and are not restrictive of the invention as claimed. The accompanying drawings, which are incorporated in and constitute part of the specification, illustrate embodiments of the present invention and together with the general description, serve to explain principles of the present invention The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which:

FIG. 3 is a first perspective view thereof;

FIG. 4 is a second perspective view thereof;

FIG. 5 is a third perspective view thereof;

FIG. 6 is a top plan view of a first operable configuration of the novel device;

FIG. 7 is a top plan view of a second operable configuration;

FIG. 8 is a top plan view of a third operable configuration;

FIG. 9 is a top plan view of a fourth operable configuration; and

DETAILED DESCRIPTION OF THE PREFERRED EMBODIMENT

Figure 1:
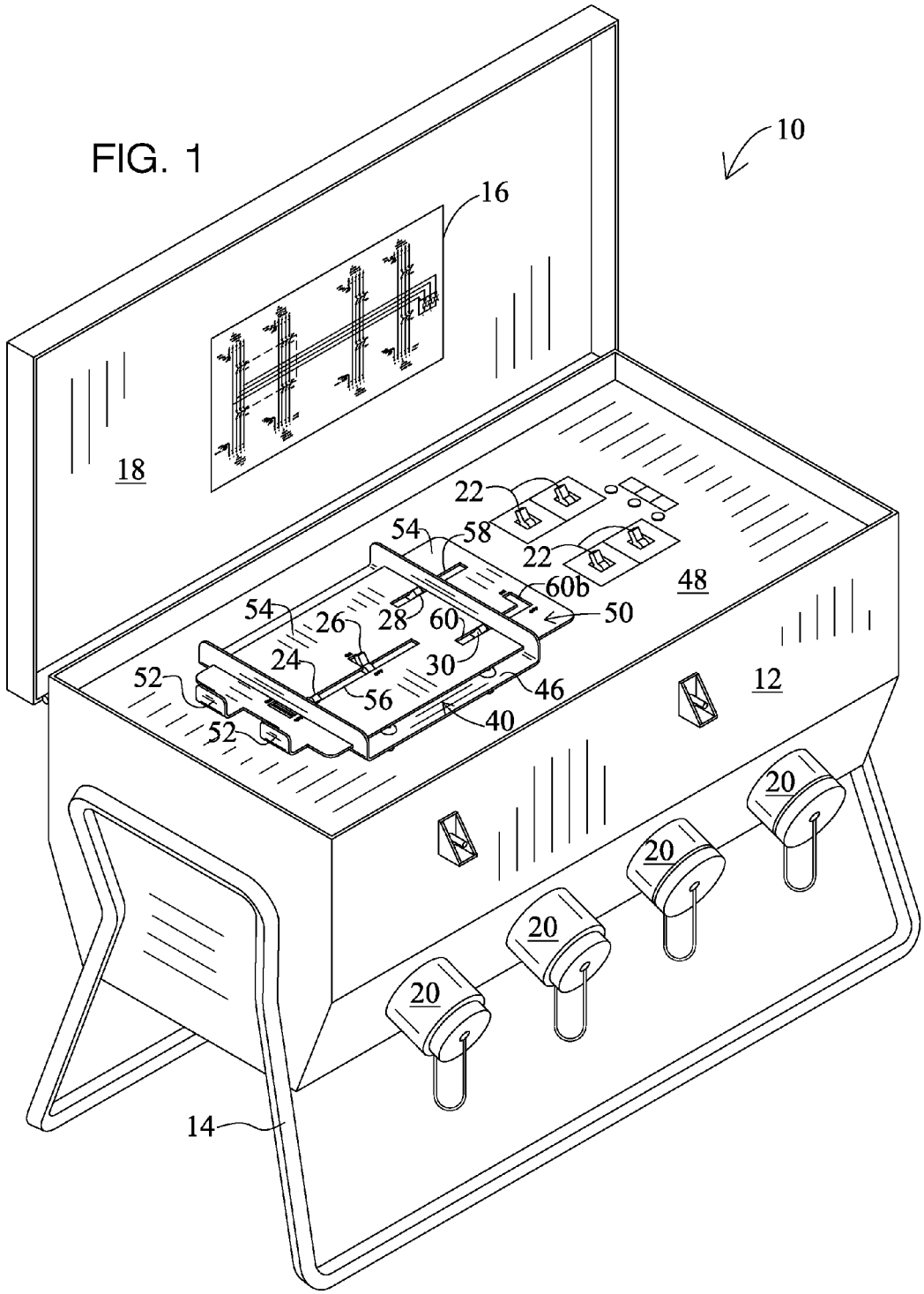
FIG. 1 is a perspective view of the housing for the novel device.
Figure 2:
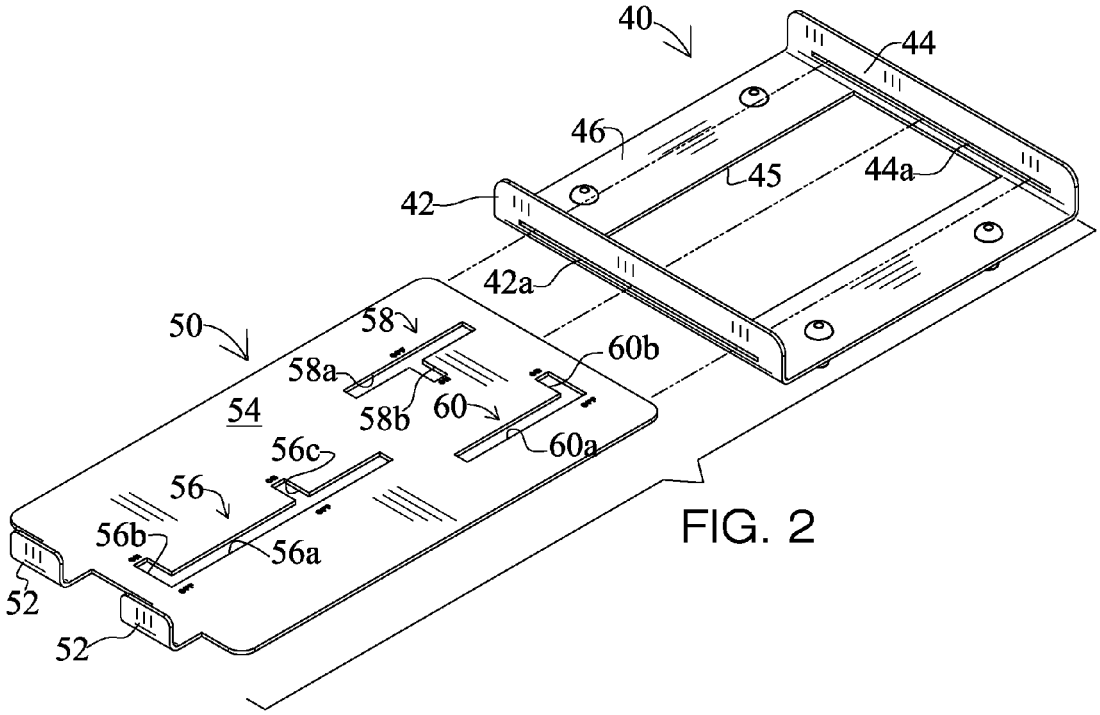
FIG. 2 is an exploded perspective view of the novel slide bar interlocking device.

Referring now to FIG. 1, it will there be seen that an illustrative embodiment of the novel slide bar interlocking device is denoted as a whole by the reference numeral 10.

Device 10 includes an open-top box-like housing 12 that is supported by legs 14 that are flared forward and rearward for stability. Electrical schematic 16 is advantageously mounted on the interior wall of lid 18 which is hingedly mounted to housing 12. Items 20 are fuses and items 22 are unconstrained switches. Said four (4) unconstrained switches 22 are sometimes hereinafter referred to as the second group of switches. Switches 24, 26, 28, and 30 are constrained switches, i.e., they cannot be thrown when constrained. The four (4) constrained switches are sometimes hereinafter referred to as the first group of switches.

Interlocking plates 40 and 50 are depicted in FIG. 1 but their structure is more fully disclosed in the perspective views of FIGS. 2-5.

Base plate 40 is generally "U"-shaped, having walls 42, 44 that are disposed substantially normal to the plane of middle section 46. Middle section 46 is bolted to mounting plate 48 (FIG. 1) that closes the open top of housing 12. Rectangular opening 45 is formed in said middle section 46. Each wall 42, 44 is slotted as at 42*a*, 44*a*, respectively, to slideably receive movable plate 50. Base plate 40 is not movable because it is mounted to mounting plate 48 as aforesaid. All eight (8) switches extend through openings formed in mounting plate 48 and have a fixed position.

Movable plate 50 includes stop tabs or handles 52, 52 that are disposed normal to and formed integrally with flat section 54. Flat section 54 has three elongate slots formed therein, denoted 56, 58, and 60.

As best depicted in FIGS. 6-9, slot 56 has a longitudinally extending section 56*a*, a first transversely extending section 56*b*, and a second transversely extending section 56*c*. First transversely extending section 56*b* is positioned at a leading end of section 56*a* and second transversely extending section 56*c* is positioned about two-thirds of the length of slot 56 as measured from said leading end.

Slot 58 has a longitudinally extending section 58*a* and a transversely extending section 58*b*. Said transversely extending section 58*b* is positioned about mid-length of slot 58.

Slot 60 has a longitudinally extending section 60*a* and a transversely extending section 60*b*. Said transversely extending section 60*b* is positioned at a trailing end of said slot 60.

The operation of device 10 is best understood in connection with FIGS. 6-9. A user slides movable plate 50 relative to unmovable base plate 40 and fixed position switch actuators 22, 22, 22, 22, 24, 26, 28, and 30 by pulling or pushing handles 52, 52.

To enable the throwing of constrained switch 24 in conjunction with any unconstrained switch 22 in the second group of switches while constraining switches 26, 28, and 30 against being thrown, the user slides movable plate 50 to the position depicted in FIG. 6. This aligns switch 24 with transverse slot 56*b*, thereby enabling the throwing of said switch 24. Switch 26 is misaligned with transverse slot 56*c*, switch 28 is misaligned with transverse slot 58*b*, and switch 30 is misaligned with transverse slot 60*b*.

To enable the throwing of constrained switch 26 in conjunction with any unconstrained switch 22 in the second group of switches while constraining switches 24, 28, and 30 against being thrown, the user slides movable plate 50 to the position depicted in FIG. 7. This aligns switch 26 with transverse slot 56*c*, thereby enabling the throwing of said switch 26. Switch 24 is misaligned with transverse slot 56*b*, switch 28 is misaligned with transverse slot 58*b*, and switch 30 is misaligned with transverse slot 60*b*.

To enable the throwing of constrained switch 28 in conjunction with any unconstrained switch 22 in the second group of switches while constraining switches 24, 26, and 30 against being thrown, the user slides movable plate 50 to the position depicted in FIG. 8. This aligns switch 28 with transverse slot 58*b*, thereby enabling the throwing of said switch 28. Switch 24 is misaligned with transverse slot 56*b*, switch 26 is misaligned with transverse slot 56*c*, and switch 30 is misaligned with transverse slot 60*b*.

To enable the throwing of constrained switch 30 in conjunction with any unconstrained switch 22 in the second group of switches while constraining switches 24, 26, and 28 against being thrown, the user slides movable plate 50 to the position depicted in FIG. 9. This aligns switch 30 with transverse slot 60*b*, thereby enabling the throwing of said switch 30. Switch 24 is misaligned with transverse slot 56*b*, switch 26 is misaligned with transverse slot 56*c*, and switch 28 is misaligned with transverse slot 58*b*.

Figure 10:
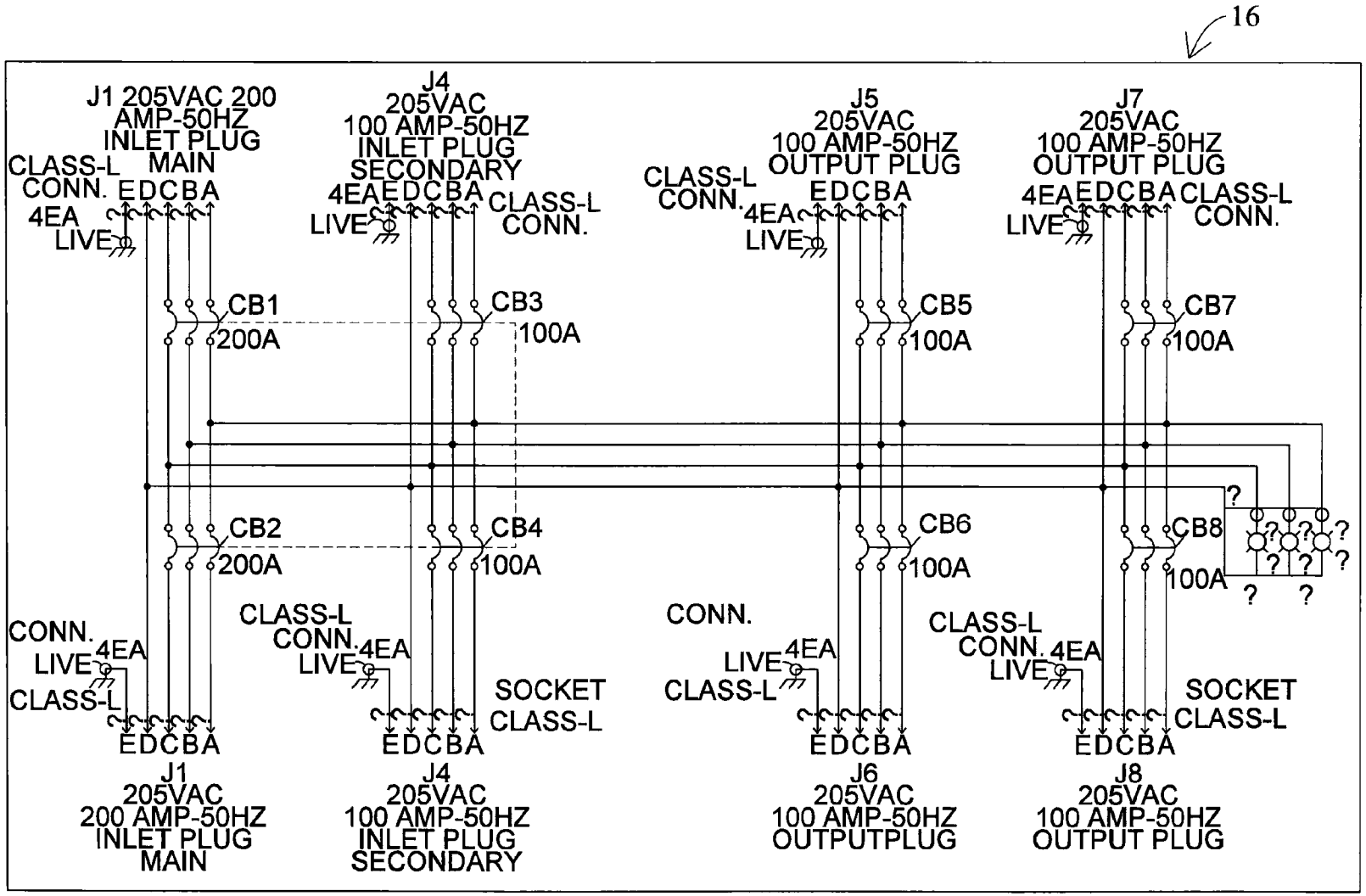
FIG. 10 is an electrical schematic diagram of the device.

A more detailed view of electrical schematic 16 is depicted in FIG. 10.

The concept behind this invention may be adapted to many other housings; the invention is not restricted to the example provided herein for explanatory purposes. The location and extent of the longitudinal slots and transverse slots can be changed depending upon the location of the switches that are to be constrained. Base plate 40, depicted herein as being slideable in a lateral or longitudinal direction, may be mounted for sliding in a direction perpendicular to said direction. Nor is the invention limited to eight (8) switch actuators that are grouped into a first group of four (4) constrained switch actuators and a second group of four (4) unconstrained switch actuators.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A slide bar interlocking device, comprising:

a first group of switch actuators and a second group of switch actuators;

each switch actuator in said second group of switch actuators being unconstrained so that any switch actuator in said second group and any combination of switch actuators in said second group can be thrown at any time;

each switch actuator in said first group of switch actuators being constrained when any preselected switch actuator in said first group is unconstrained so that only one unconstrained switch actuator in said first group may be thrown in combination with any switch actuator in said second group and any combination of switch actuators in said second group;

a base plate having a fixed position;

a movable plate that is slideably mounted to said base plate;

a plurality of elongate slots formed in said movable plate;

at least one truncate slot formed in each of said elongate slots in open communication therewith and in normal relation thereto;

said movable plate having a first position where a first switch actuator in said first group of switch actuators is in alignment with a first truncate slot so that said first switch actuator can be thrown and where all other switch actuators in said first group of switch actuators are not in alignment with a truncate slot so that none of said all other switch actuators can be thrown;

said movable plate having a second position where a second switch actuator in said first group of switch actuators is in alignment with a second truncate slot so that said second switch actuator can be thrown and where all other switch actuators in said first group of switch actuators are not in alignment with a truncate slot so that none of said all other switch actuators can be thrown;

said movable plate having a third position where a third switch actuator in said first group of switch actuators is in alignment with a third truncate slot so that said third switch actuator can be thrown and where all other switch actuators in said first group of switch actuators are not in alignment with a truncate slot so that none of said all other switch actuators can be thrown.

2. The device of claim 1, further comprising:

said movable plate having a fourth position where a fourth switch actuator in said first group of switch actuators is in alignment with a fourth truncate slot so that said fourth switch actuator can be thrown and where all other switch actuators in said first group of switch actuators are not in alignment with a truncate slot so that none of said all other switch actuators can be thrown.

3. The device of claim 1, further comprising:

said plurality of elongate slots including a first elongate slot, a first truncate slot, and a second truncate slot, said first and second truncate slots being spaced apart from one another and said first and second truncate slots being formed in open communication with said first elongate slot and said first and second truncate slots being disposed normal to said first elongate slot.

4. The device of claim 3, further comprising:

said first truncate slot positioned at a leading end of said first elongate slot.

5. The device of claim 4, further comprising:

said second truncate slot positioned about two-thirds of the length of said first elongate slot, measured from said leading end.

6. The device of claim 3, further comprising:

said plurality of elongate slots including a second elongate slot and a first truncate slot, said first truncate slot being formed in open communication with said second elongate slot and said first truncate slot being disposed normal to said second elongate slot.

7. The device of claim 6, further comprising:

said first truncate slot being formed in said second elongate slot about mid-length thereof.

8. The device of claim 3, further comprising:

said plurality of elongate slots including a third elongate slot and a first truncate slot, said first truncate slot being formed in open communication with said third elongate slot and said first truncate slot being disposed normal to said third elongate slot.

9. The device of claim 8, further comprising:

said first truncate slot being formed in said third elongate slot at a trailing end thereof.

* * * * *